US007143499B2

(12) United States Patent
Seidel et al.

(10) Patent No.: US 7,143,499 B2
(45) Date of Patent: Dec. 5, 2006

(54) METHOD AND INSTALLATION FOR PRODUCING METAL STRIPS AND SHEETS

(75) Inventors: Jürgen Seidel, Kreuztal (DE); Günter Kneppe, Hilchenbach (DE); Joachim Hafer, Siegen (DE)

(73) Assignee: SMS Demag AG, Düsseldorf (DE)

( * ) Notice: Subject to any disclaimer, the term of this patent is extended or adjusted under 35 U.S.C. 154(b) by 77 days.

(21) Appl. No.: 10/380,441

(22) PCT Filed: Aug. 23, 2001

(86) PCT No.: PCT/EP01/09721

§ 371 (c)(1),
(2), (4) Date: Jun. 10, 2003

(87) PCT Pub. No.: WO02/24355

PCT Pub. Date: Mar. 28, 2002

(65) Prior Publication Data

US 2004/0025320 A1 Feb. 12, 2004

(30) Foreign Application Priority Data

Sep. 22, 2000 (DE) ..... 100 47 044

(51) Int. Cl.
*B21B 1/46* (2006.01)

(52) U.S. Cl. ..... 29/527.7; 29/33 C; 29/527.6; 148/584; 165/417; 165/476

(58) Field of Classification Search ..... 29/527.7, 29/527.6, 33 C; 148/584; 164/417, 476, 164/477, 459, 481; 72/365.2, 366.2
See application file for complete search history.

(56) References Cited

U.S. PATENT DOCUMENTS 4,998,338 A * 3/1991 Seidel et al. ..... 29/527.6
5,056,583 A * 10/1991 Morii et al. ..... 164/453
5,115,547 A * 5/1992 Rohde ..... 29/33 C
5,435,164 A * 7/1995 Di Giusto et al. ..... 72/202
5,528,816 A * 6/1996 Donini et al. ..... 29/527.7

(Continued)

FOREIGN PATENT DOCUMENTS

EP 0665296 * 8/1995

(Continued)

OTHER PUBLICATIONS

Translation of JP 57-149008 (Kawasaki Steel). USPTO Translation branch.*

(Continued)

*Primary Examiner*—Eric Compton
(74) *Attorney, Agent, or Firm*—Friedrich Kueffner

(57) ABSTRACT

The invention relates to a method for producing metal strips and sheets involving the following method steps: pouring a strand, which is provided in the form (1) of thin slabs and which is comprised of carbon steel or special steel, into a casting machine (4) and rolling the cast product away from the casting heat. The aim of the invention is to utilize free capacities of existing installations, that is, installations not operating at full capacity, with which primary carbon steels are produced, in order to supplement other types of steel or to supplement cast products produced in another manner. To this end, the invention provides that, together with these first cast products (1), at least second cast products (2), which are produced in a second process route (II) from special steel if the first thin slabs are cast from carbon steel or are produced from carbon steel if the first thin slabs are cast from special steel, are rolled within a joint rolling program.

12 Claims, 3 Drawing Sheets

U.S. PATENT DOCUMENTS

| | | | | |
|---|---|---|---|---|
| 5,964,275 | A * | 10/1999 | Flick et al. | 164/417 |
| 2004/0108701 | A1 | 6/2004 | Kleinhoffer et al. | |
| 2005/0039320 | A1 * | 2/2005 | Thomanek | 29/527.7 |

FOREIGN PATENT DOCUMENTS

| | | | |
|---|---|---|---|
| EP | 0808672 | | 11/1997 |
| JP | 10-034289 | * | 2/1998 |
| JP | 11-033601 | * | 2/1999 |

OTHER PUBLICATIONS

Translation of W. Rohde et al. Article. USPTO Translation branch.*

Patent Abstracts of Japan, vol. 006, No. 249 (M-177), Dec. 8, 1982 & JP 57 146403 A (Kawasaki Seitetsu KK), Sep. 9, 1982.

Patent Abstracts of Japan, vol. 006, No. 249 (M177), Dec. 8, 1982 & JP 57 146404 A (Kawasaki Seitetsu KK), Sep. 9, 1982.

Patent Abstracts of Japan, vol. 006, No. 253 (M-178), Dec. 11, 1982 & JP 57 149007 A (Kawasaki Seitetsu KK), Sep. 14, 1982.

Patent Abstracts of Japan, vol. 006, No. 253 (M-178 Dec. 11, 1982 & JP 57 149008 A (Kawasaki Seitetsu KK), Sep. 14, 1982.

Rohde W: "Compact Strip Production (CSP) : The Approach for Economical . . . ", Revue De Metallurgie, Paris, Fr, BD. 91, No. 4, Apr. 1, 1994, pp. 532-540.

Rohde W et al: "Stand, Leistungsvermögen Und Weiterentwicklung Der . . . ", Verlag Stahleisen GMBH, Düsseldorf, BD. 115, No. 9, Sep. 15, 1995.

Materials World, vol. 6, No. 8, pp. 483-484 (Aug., 1998).

* cited by examiner

Material
rolling program
number of strips
special steel
carbon steel carbon steel
special steel
8
9
1
2
3
4
5
6
7
10a
10b
11
12
13
14
15a
16a
16b
17a
17b
18
19
20
21
22
22a
23
24
25
26
27
28
I
II

METHOD AND INSTALLATION FOR PRODUCING METAL STRIPS AND SHEETS

BACKGROUND OF THE INVENTION

1. Field of the Invention

The invention concerns a process for producing steel strips and sheets. In addition, the invention concerns an installation for carrying out the process.

2. Description of the Related Art

Thin slabs are defined here as cast products with a thickness of 30–130 mm and especially 40–60 mm. EP 0 808 672 A1 describes a process and installation for producing special steel or carbon steel plate from thin slabs produced by continuous casting. In this process, a strand of thin slab 40–100-mm thick is cast either from molten special steel or from molten carbon steel and divided into individual thin slabs, which are conveyed through a heating line and then continuously rolled.

*Stahl und Eisen*, Vol. 115, No. 9, pp. 89–99, 1995 describes results for different grades of steel processed by the generic process, which is also known as "CSP" technology. These results include the direct charging of special steels, such as the material group of stainless Cr steel with C≦0.10% and Cr≧13% and the material group of stainless CrNi steel with C≦0.10% and Cr≧17%.

JP-A-57[1982]-146,403 concerns a hot-rolling line for cast products, which originate, on the one hand, in a conventional continuous casting plant and, on the other hand, in a strip casting plant. The conventional plant is distinguished by a primary rolling stand installed in front of the finish rolling mill. In a further development of this idea, JP-A-146,404 describes the insertion of the cast products into a common rolling mill by means of a ferry, which operates as a function of the casting and rolling plan.

JP-A-57[1982]-149,007 describes the production of steels of comparatively low quality by strip casting and the rolling of these steels in a rolling mill together with steels of higher quality produced by a conventional continuous casting plant. In a further development of this idea, JP-A-57[1982]-149,008 proposes that both the products from the conventional continuous casting plant and the products from the strip casting plant be fed to a common furnace and then to a rolling mill that includes primary rolling stands and finish rolling stands.

SUMMARY OF THE INVENTION

The goal of the invention is further development of a process and an installation for the purpose of making it more economical to produce strips and sheets made of special steel.

With respect to the process, this goal is achieved by rolling at least two series of cast products within a common rolling program, such that, if the first cast products produced in a first process route are cast from carbon steel, then the second cast products produced in a second process route are cast from special steel and vice versa. Thus, the crux of the invention is to integrate products of both types of steel in a common rolling mill in one installation and to roll both types of products within a common rolling program. The term "rolling program" is generally defined as the specified sequence of slabs to be rolled in the period of time between two roll changes.

The invention achieves optimal utilization of an installation, which would not be optimally utilized if used solely for the production of special steel sheets, which are produced in smaller amounts compared to carbon steels. In addition, greater variability of an installation in which carbon steels are produced is achieved by additionally rolling special steels. In principle, the invention is not limited to a rolling program for cast products made of the two types of steel; the rolling of additional types of steel in a rolling program is also conceivable, but carbon steels and special steels are always rolled together. The proposal of the invention to carry out the rolling in a common rolling program makes it possible to process two very different types of steel independently of the throughput capacity of an installation and of the steel production output.

The term "special steel" is basically defined in EN 10 020. In this regard, a distinction is made between unalloyed and alloyed special steels. The special steels in accordance with the invention include, for example, antifriction bearing steels, tool steels, creep-resistant steels and high-grade structural steels. In particular, this term includes high-alloy steels with alloying elements and amounts that stabilize the austenitic structure towards lower temperatures, especially high-alloy austenitic CrNi steels.

To avoid loss of quality in the finished product, the rolling mill is adapted to the given material to be processed during the rolling program. This means that the rolling mill is already being prepared for the next material to be processed in the rolling program, while the previous material is still being processed. In particular, this means that the negative effects of the rolling of the special steel on the surfaces of the work rolls, which usually take the form of rough surfaces and have an interfering effect on the subsequent rolling of the carbon steels, are eliminated during the operation or online. The negative effects of the carbon steel rolling in the form of a larger amount of loose scale, which would be pressed into the surface of the following special steel product, are similarly removed during the operation or online during the rolling of the carbon steels. The rolling mill is optimally prepared for the next rolling product in this way.

Alternatively or supplementarily, the rolling mill is also prepared for the following strip during the interruption in rolling between the rolling operations on two strips.

In a preferred embodiment, the first cast products in thin slab format or groups of them and the second cast products or groups of second cast products are alternately rolled. The term "alternation" can mean irregular or regular alternation of slabs of the two types of steel. A regular alternation, as is proposed as preferable in claim 2, and thus a regular succession of the relatively softer carbon steels and relatively harder special steels, produces a lower mean load for the drives of the work rolls, and a high load is immediately compensated by a lower load.

The second cast products, which are rolled in one rolling program together with the thin slabs of the first process route, are also thin slabs. The thin slabs, which are cast and cut in a second process route parallel to the first process route, are preferably passed, if necessary, through a second reheating furnace and a ferry, into a common reheating furnace and then the rolling mill.

The invention is not limited to the above-described possibility of integration of thin slabs; the integration of any type of cast product, e.g., products produced by strip casting, is conceivable, although preliminary products produced in this way already have small initial thicknesses.

With respect to the equipment, it is proposed that a generic installation be equipped with an integration unit for the introduction of at least second cast products made of special steel, if the first cast products from the first process line are cast from carbon steel, or for the introduction of at least second cast products made of carbon steel, if the cast products from the first process line are cast from special steel, and with a rolling mill for a combined rolling program for cast products made of carbon steel and special steel and preferably with means for preparing the rolling mill for the next rolling product made of the other type of steel.

Grinding and/or polishing equipment is provided for the work rolls of at least one rolling stand as means for preparing the rolling mill. This equipment counteracts a rough roll surface during the rolling of the special steel product and/or during the interruption in rolling. This equipment, e.g., grinding equipment that presses against a work roll, is installed on the run-in side, preferably on all rolling stands of the rolling mill. At the same time, the rolling mill has rinsing equipment, which operates especially or to a greater extent during the rolling of the carbon steel products and/or during the subsequent interruption of rolling and frees the rolling mill of the loose scale of the carbon steels. Claims 8 to 10 propose additional equipment, which is provided alone or additionally in the rolling mill for the purpose of obtaining good surface qualities despite the rolling of second types of steel with different rolling properties and negative effects on the rolling mill and thus on the surface properties of the following products. Alternatively or additionally, rolls that are especially resistant to wear may be used. In particular, it is proposed that rolls be used which were produced by the powder-metallurgical HIP process as well as rolls made of high-speed steels.

Further details and advantages of the invention are found in the secondary claims and in the following description, which explains in greater detail the embodiments of the invention shown in the drawings. In this regard, in addition to the combinations of features specified above, features alone or in other combinations also fall within the scope of the invention.

DESCRIPTION OF THE PREFERRED EMBODIMENTS

Figures 1, 2:
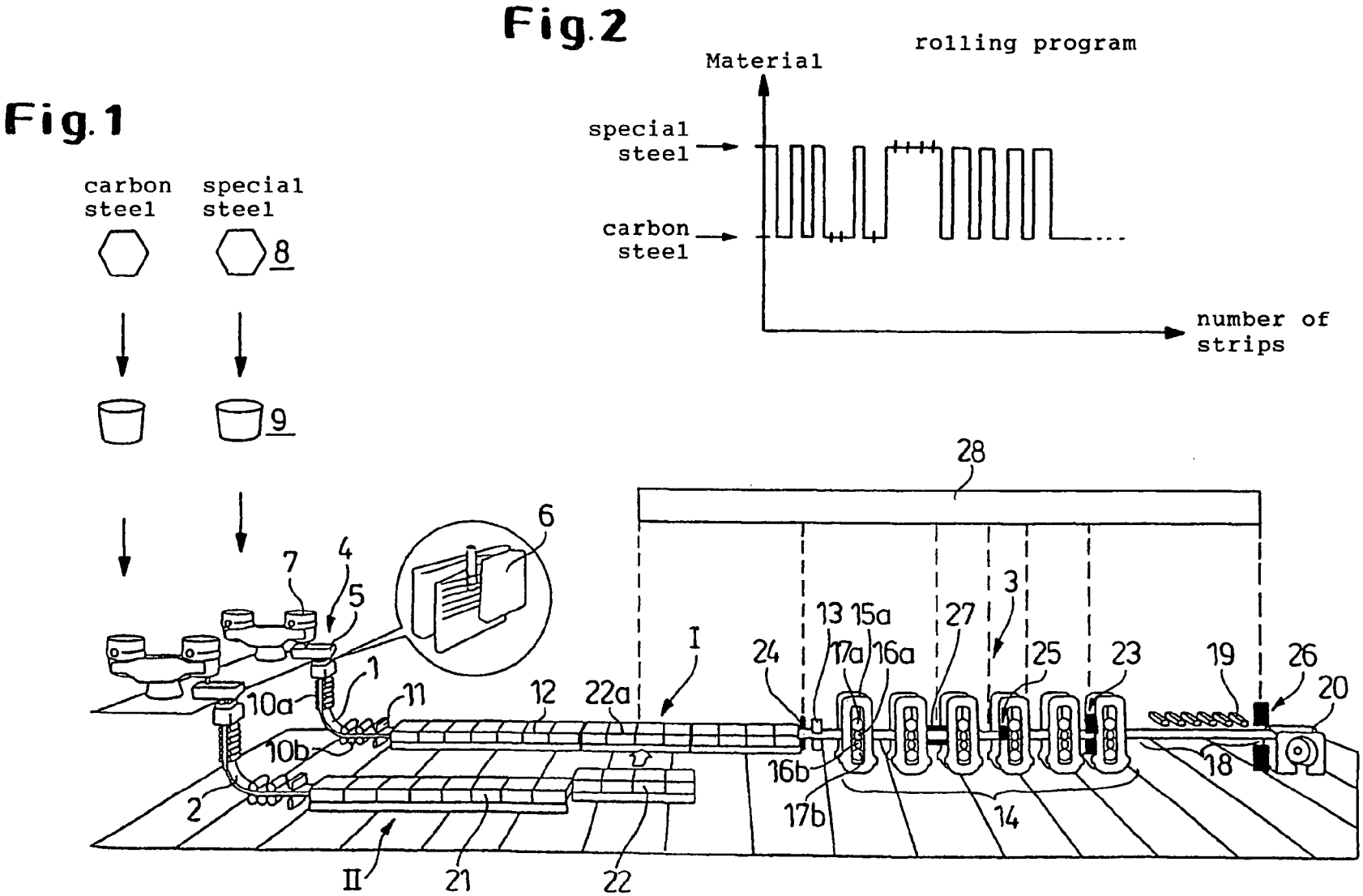
FIG. 1 is a schematic representation of an installation for casting and rolling thin slabs with two casting strands and a common rolling mill in accordance with a first embodiment of the invention.
FIG. 2 shows the nature and sequence of a rolling program in diagram form.

FIG. 1 shows an installation with two casting strands or two cast products 1, 2, in which the first process route I comprises a rolling mill 3 preceded by a casting machine 4. The first casting machine 4 has a tundish 5 and a funnel-shaped thin slab mold (shown schematically enlarged here) for casting thin slabs with thicknesses of 40–100 mm. The casting machine 4 itself is fed in the present example with molten special steel from ladle 7. The molten steel is produced, for example, by a blast furnace-converter route (labeled 8) or with an electric steel furnace followed by secondary metallurgical operations and then conveyed to the casting machine in the ladles 7 (the conveyance step is labeled 9).

The cast product in the form of the casting strand is turned from the vertical to the horizontal by rolls 10*a, b* and, in the present embodiment, is cut to length by a first set of shears 11. The individual thin slabs then enter a first reheating furnace 12, for example, a roller hearth furnace or rocker bar furnace, in which a uniform thin slab temperature is produced. The thin slabs then pass through a descaling system 13 and into the rolling mill, in which the desired final dimensions are produced. The finish rolling step 14 of the rolling mill consists here of six rolling stands (e.g., 15*a*), each with two work rolls (16*a,b*) and two support rolls (17*a,b*). This is followed by a runout table 18 with cooling equipment 19 and a coiler 20 for winding the strip into a coil.

In a second, parallel process route II, the installation shown in FIG. 1 has a second cast product in the form of casting strand 2, which is made of carbon steel. This process route consists solely of the reheating furnace 21 with the same structural units as process route I described above, so there is no need to discuss it in further detail. The first process route I includes an integration unit for the thin slabs from the second process route II. This integration unit consists of a ferry 22, which can be transversely inserted into a section 22*a* of the first reheating furnace 12 by moving the section 22*a* to the other side.

In accordance with the invention, a common rolling program is operated in the rolling mill 3. An example of a rolling program of this type is illustrated in FIG. 2, in which the particular type of steel is plotted against the number of strips. In this example, the rolling program begins after the change of the work rolls with the rolls of a special steel cast product, followed by a cast product made of carbon steel. The sixth to eighth slabs are then made of carbon steel, and the twelfth to sixteenth as a group are made of special steel. FIG. 2 serves only as an example of a possible common rolling program.

The rolling of the special steel results in rougher roll surfaces, which would have disturbing effects on the immediately following rolling of carbon steel, such as, for example, the rolling in of scale and rougher strip surfaces. Therefore, the rolling mill has grinding and/or polishing machines installed on each of the rolling stands. For example, a machine of this type, which is labeled with reference number 23, acts on the upper and lower work rolls. In addition, an edge heater 24 is provided, which is installed in front of the descaling system 13. This heater may be, for example, an induction heater or gas-fired heater.

In addition, devices (labeled here as 25 by way of example) for lubricating the roll gap are provided to reduce the friction between the work rolls. These devices are installed, specifically, only on the run-in side of the rolling stand. It is also advisable to use wear-resistant rolls, e.g., work rolls produced by the powder-metallurgical HIP process (high-isostatic pressing) or made of high-speed steels (HSS). In addition, it is advisable to install a strip surface inspection system 26 after the rolling mill and just before the coiler 20 and a camera to monitor the roughness of the strip and rolls. This monitoring system makes it possible to assess product quality online or during operation and, depending on the monitoring results, to determine the length, i.e., the duration, of the rolling program, which can thus be consistently extended with good quality results. In this regard, the surface inspection is preferably aimed at strip roughness and the rolling in of scale.

The loose scale formed during the rolling of carbon steels, which could be pressed into the surface of a subsequently rolled special steel strip, is removed by a rinsing system (labeled 27 by way of example) in the strip side guides. This system preferably operates in such a way that the wipers (not shown) of the rinsing system are intermittently swung out, and during this period of time the rinsing medium is applied to the surface of the roll and between the stands under high pressure by suitable high-pressure nozzles (not shown) in order to flush out scale or abrasive particles that may be present.

In addition, of course, the strip quality can also be improved by the use and controlled actuation of the section final control elements for shifting work rolls and adjusting roll bending.

It is proposed that the sequence of the entrance of a first thin slab, a group of first thin slabs, i.e., from the first process route I, of a second cast product or a group of second cast products into the rolling mill and the duration of the common rolling program, i.e., the period of time between the changing of the work rolls, be computer assisted on the basis of a process model. The use and duration of use of the grinding and polishing machines or of the rinsing systems for removing the scale of the carbon steels as well as of other systems designed to improve the strip surface are also controlled on the basis of this process model. A control unit of this type is designated schematically by reference number 28. In addition, the permissible jumps in the width of the cast products to be successively rolled can be taken into consideration in the rolling program according to "mixed rolling". All together, a process model of this type allows optimization of the rolling quality as a function of the desired product quality.

Figure 3:
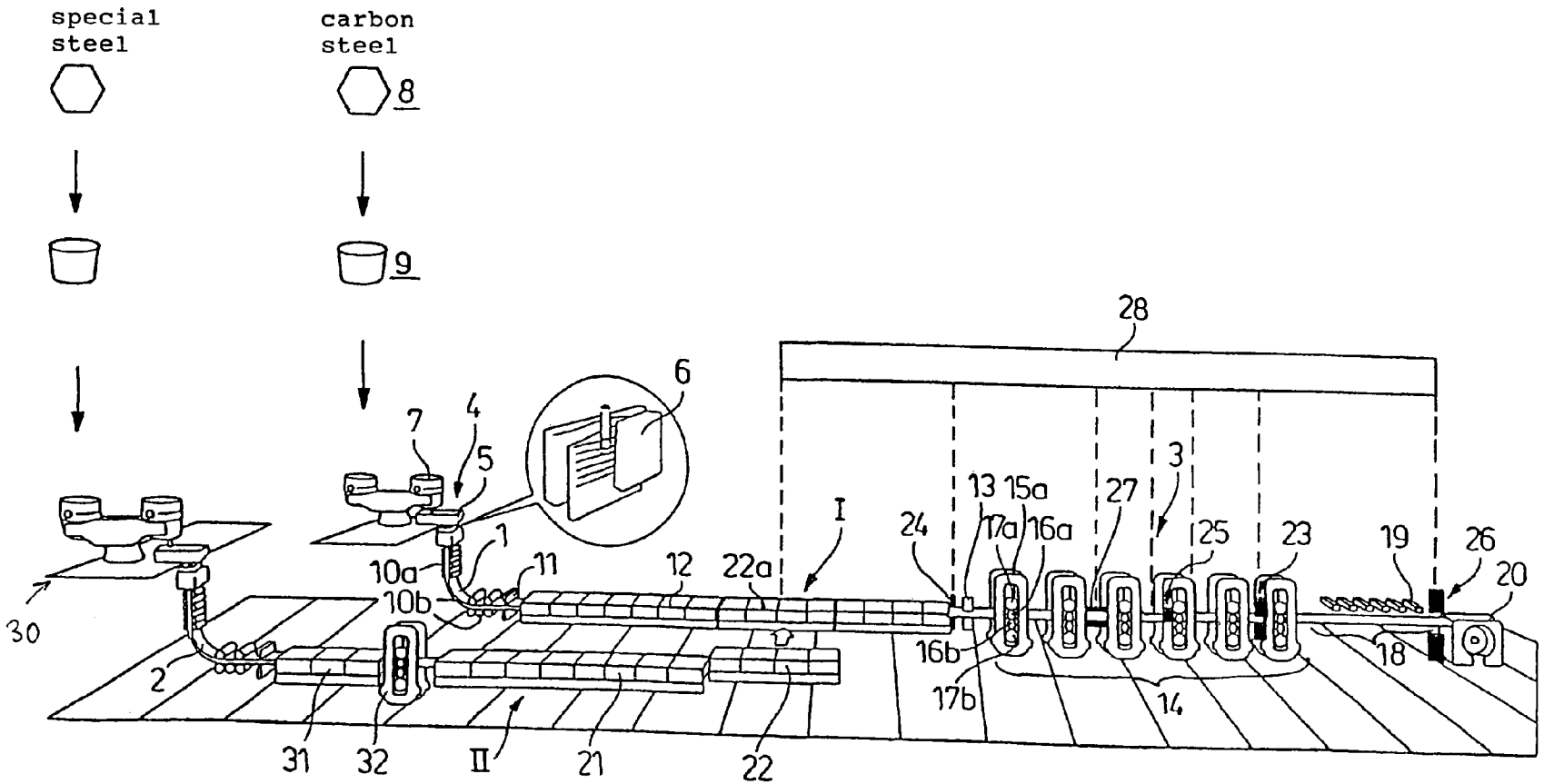
FIG. 3 is a schematic representation of an installation for casting and rolling thin slabs with one casting strand for thin slabs and one process route for a conventionally cast product to show the technological background of the invention.

The installation shown in FIG. 3 is the same as that shown in FIG. 1 with respect to its first process route I. In contrast to FIG. 1, the second cast products (2) integrated in process route I are cast with thicknesses up to 250 mm by a conventional casting machine 30 and, possibly after cooling and reheating in a furnace 31, rolled down in a primary rolling stand 32 to a thickness such that they can be integrated in the common rolling mill of process route I. The conventional sequence of continuous casting and primary rolling is shown only schematically here. The individual slabs are conveyed in the cold state or possibly while still hot to a slab furnace 21 near the first process route I, in which they are heated or homogenized to suitable rolling temperatures, and then inserted in the reheating furnace 12 with a ferry 22.

Figure 4:
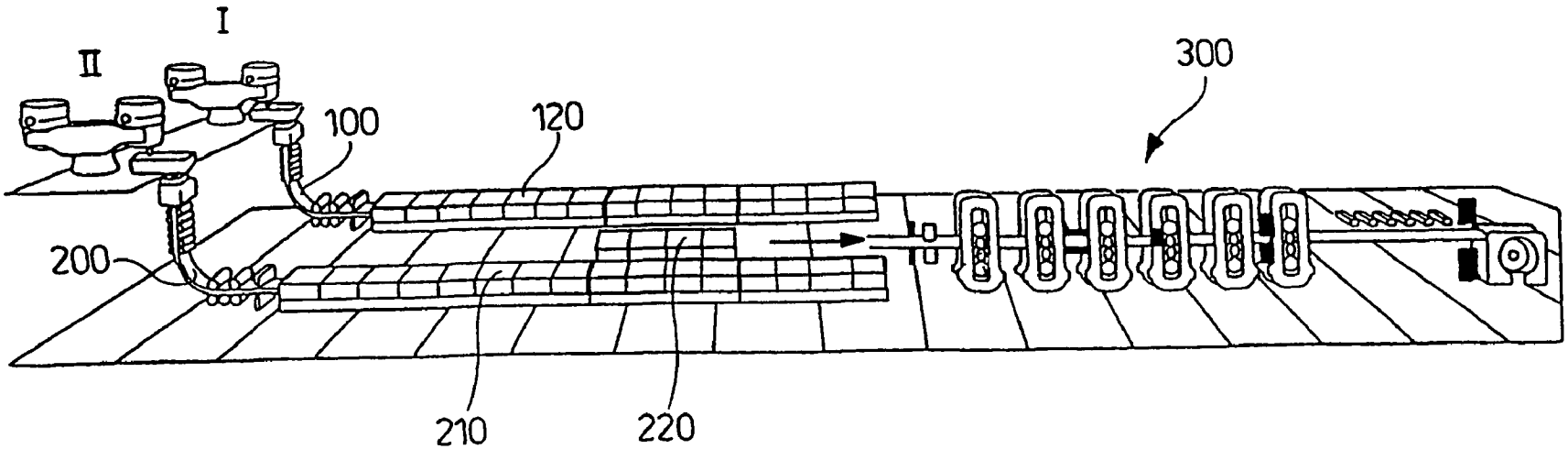
FIG. 4 is a schematic representation of an installation for casting and rolling thin slabs with two casting strands and a common rolling mill in accordance with a second embodiment of the invention.

FIG. 4 is a schematic representation of a second embodiment of the installation used to carry out the common rolling program. In this embodiment, the integration unit is a ferry 220, which conveys both the first cast products (100) and the second cast products (200), which have been cut to length, into a common rolling mill 300 as each of these groups of products comes from the two reheating furnaces (120, 210) and thus from the process routes I and II.

All together, the process of the invention for processing special steels and carbon steels in a common rolling program with the use of surface-improving measures makes it possible to produce special steels more economically than state-of-the-art processes, because free capacities of existing installations that produce primarily carbon steels, i.e., such installations that are not operating at full capacity, can be utilized to supply other types of steel or cast products produced in another way.

The invention claimed is:

1. A process for producing steel strips and sheets, the process including, together with first cast products, rolling in a rolling mill at least second cast products produced in another process route, cooling the rolling product on a runout table and coiling the product on a coiler, the improvement comprising a first process route identical to the another process route comprising casting a strand in thin slab format from a carbon steel or a special steel in a casting machine and passing the cast products through a preheating furnace to produce a uniform temperature, wherein the second cast products are also thin slabs, further comprising, together with the first cast products, rolling at least the second cast products within a common rolling program, wherein a rolling program is the period of time between two roll changes, and wherein the second cast products are of special steel when the first cast products are cast from carbon steel or the second cast products are of carbon steel if the first cast products are cast from special steel; and, during and/or after the rolling operation on the products made of carbon steel, descaling the rolling mill and the surface of the product that is to be processed or that has already been rolled, and, during and/or after the rolling operation on the products made of special steel, reducing the developing roll surface roughness, further comprising finish-rolling the product in a finish-rolling step and coiling the product.

2. The process according to claim 1, comprising alternately rolling within the common rolling program the first cast product or groups of first cast products and the second cast products or groups of second cast products.

3. The process according to claim 1, comprising rolling within the common rolling program the first cast products and the second cast products or a group thereof essentially in regular alternation.

4. The process according to claim 1, comprising casting the second cast products in a second process route parallel to the first process route, cutting the second cast products into thin slabs, and subsequently rolling the second cast products with the first thin slabs in the common rolling mill in the order conforming to the common rolling program.

5. The process according to claim 1, comprising determining and adjusting the order of entry of a first cast product, a group of first cast products, a second cast product or a group of second cast products into the rolling mill, the duration of the common rolling program, and the duration of use of means for adapting the rolling operation to the particular material to be processed.

6. The process according to claim 1, comprising determining the strip surface quality with a strip surface inspection system, and determining the operating time of the rolling program as a function of the strip surface quality.

7. An installation for carrying out a process for producing steel strips and sheets, the process including, together with first cast products, rolling in a rolling mill at least second cast products produced in another process route, cooling the rolling product on a runout table and coiling the product on a coiler, the installation comprising a first process line identical to the another process route with a casting machine for casting a strand in thin slab format from a carbon steel or a special steel and equipment for heating and/or homogenizing the temperature of the cast products; the installation further comprising an integration unit for inserting at least second cast products of special steel when the first cast products are cast from carbon steel, or for inserting second cast products of carbon steel when the first cast products are cast from special steel, into a common process line and through a rolling mill with a combined rolling program for the first cast products and the second cast products, wherein a rolling program is the period of time between two roll changes; the installation further comprising means for preparing the rolling mill for the next cast product made of another type of steel, wherein the means for preparing the rolling mill for products made of carbon steel include grinding and/or polishing equipment for the work rolls of at least one roll stand, wherein the means for preparing the rolling mill for products made of special steel include at least one rinsing device for removing scale from the strip surface and the work roll surfaces, a finish-rolling step for finish-rolling the product, and a coiler.

8. The installation according to claim 7, wherein the rinsing device comprises alternately used wipers and nozzles for applying rinsing medium under high pressure.

9. The installation according to claim 7, wherein the means for preparing the rolling mill for products made of carbon steel or special steel include a device for lubricating the roll gap, wherein different lubricants are used for lubricating the roll gap for carbon steel and for special steel.

10. The installation according to claim 7, wherein the means for preparing the rolling mill for products of carbon steel comprise one or more strip edge heaters, wherein the heaters are installed in front of the first roll stand or between the forward roll stands of the rolling mill.

11. The installation according to claim 7, wherein the work rolls of the roll stand have a high resistance to wear by using rolls produced by the powder-metallurgical HIP process or rolls made of high-speed steel.

12. The installation according to claim 7, comprising a control unit for controlling the integration unit between the two process routes for adjusting the order of entry of the cast products into the common rolling mill and for controlling means for preparing the rolling mill for the next product made of another type of steel.

* * * * *